US007582849B2

(12) United States Patent
Watanabe et al.

(10) Patent No.: US 7,582,849 B2
(45) Date of Patent: Sep. 1, 2009

(54) THERMAL HEAD, DRIVING METHOD AND THERMAL HEAD DRIVE CIRCUIT

(75) Inventors: Sumio Watanabe, Shinagawa (JP); Fumio Sakurai, Shinagawa (JP); Yukihiro Mori, Shinagawa (JP); Norio Endo, Shinagawa (JP); Shuko Yamaji, Shinagawa (JP); Tomoyuki Yokoyama, Shinagawa (JP)

(73) Assignee: Fujitsu Component Limited, Tokyo (JP)

( * ) Notice: Subject to any disclaimer, the term of this patent is extended or adjusted under 35 U.S.C. 154(b) by 0 days.

(21) Appl. No.: 11/420,112

(22) Filed: May 24, 2006

(65) Prior Publication Data

US 2007/0045280 A1 Mar. 1, 2007

(30) Foreign Application Priority Data

Sep. 1, 2005 (JP) ..... 2005-253863

(51) Int. Cl.
*H05B 1/02* (2006.01)

(52) U.S. Cl. ..... 219/481; 219/497; 219/483; 219/486; 399/67; 307/39

(58) Field of Classification Search ..... 219/481, 219/483–487, 216, 503, 497, 505, 499, 501, 219/508; 307/38–41; 347/40–43; 399/67–69
See application file for complete search history.

(56) References Cited

U.S. PATENT DOCUMENTS

| | | | | | |
|---|---|---|---|---|---|
| 5,455,611 | A * | 10/1995 | Simon et al. | ..... | 347/49 |
| 5,673,071 | A * | 9/1997 | Fuse | ..... | 347/35 |
| 6,827,423 | B1 * | 12/2004 | Katakura et al. | ..... | 347/40 |
| 2007/0109351 | A1 * | 5/2007 | Mitsuzawa | ..... | 347/40 |

* cited by examiner

*Primary Examiner*—Mark H Paschall
(74) *Attorney, Agent, or Firm*—Staas & Halsey LLP

(57) ABSTRACT

A thermal head driving method of driving thermal heads is disclosed. The method includes a step of dividing the thermal heads into plural groups, providing for each of the groups a common potential terminal, a step of using a drive circuit to drive the thermal heads of one or more of the groups, and a step of applying an operating voltage to the common potential terminal of said one or more groups driven by the drive circuit.

3 Claims, 10 Drawing Sheets

THERMAL HEAD, DRIVING METHOD AND THERMAL HEAD DRIVE CIRCUIT

BACKGROUND OF THE INVENTION

1. Field of the Invention

The present invention generally relates to a thermal head which has new driving method and a thermal head drive circuit, and particularly relates to a thermal head driving method and a thermal head drive circuit for driving thermal heads.

2. Description of the Related Art

Thermal head drive circuits include IC-mounted type and diode matrix type.

FIG. 1 is a block diagram showing a configuration of an IC-mounted drive circuit 10.

The IC-mounted drive circuit 10 comprises heater elements 11 and a driver IC 12. Each of the heater elements has an end to which a common potential is applied and the other end connected to the driver IC 12. The driver IC 12 comprises flip-flops, latch and driver elements equal in number. The driver IC 12 sequentially transfers serially-transferred data items in synchronization with clock, latches the data items into the flip-flops at the time of printing, and drives drivers with strobe signals according to the data items latched in the flip-flops so as to apply current to the heater elements 11. With this configuration, the driver IC 12 needs to have the same number of drivers as the number of driver elements.

FIG. 2 is a block diagram showing a configuration of a diode matrix type drive circuit 20.

The diode matrix type drive circuit 20 comprises heater elements 21, a driver IC 22, and diode drive group control ICs 24. The heater elements 21 are divided into groups of n heater elements 21 each. The n heater elements 21 in each group are connected through corresponding backflow prevention diodes 23 to the corresponding drive group control IC 24. The driver IC 22 can drive n heater elements 21 independently at the same time, and can drive the heater elements 21 by group.

As described above, since IC-mounted drive circuits require the same number of drivers as the number of driver elements, the size of driver ICs is large. On the other hand, diode matrix type thermal head drive circuits require the same number of diodes as the number of driver elements, and therefore the size of the drive circuits is large.

SUMMARY OF THE INVENTION

The present invention solves one or more of the above described problems. The present invention is directed to provide a thermal head driving method and a thermal head drive circuit capable of efficiently driving thermal heads with a simple structure.

According to one aspect of the present invention, there is provided a thermal head driving method of driving thermal heads that comprises a step of dividing the thermal heads into plural groups, providing for each of the groups a common potential terminal, a step of using a drive circuit to drive the thermal heads of one or more of the groups, and a step of applying an operating voltage to the common potential terminal of said one or more groups driven by the drive circuit.

It is preferable that the above-described thermal head driving method further comprise a step of switching the common potential terminal of groups not driven by the drive circuit into an open-circuit condition.

It is preferable that the above-described thermal head driving method further comprise a step of applying a predetermined common potential to the common potential terminal of the groups not driven by the drive circuit.

It is also preferable that the above-described thermal head driving method further comprise a step of driving the thermal heads based on evaluation data, and a step of detecting a failure by detecting a current to be supplied to a power supply terminal.

In the above-described thermal head driving method, it is preferable that a common potential be supplied to the power supply terminal via plural power supply lines divided into two or more groups so as to perform the failure detection in each of the groups, and a power be supplied via the power supply lines in the group in which the failure is not detected so as to perform printing operation. The above-described thermal head driving method preferably further comprises a step of reducing a printing speed when a failure is detected.

In one embodiment of the present invention, since a thermal head driving method of driving thermal heads comprises a step of dividing the thermal heads into plural groups, providing a common potential terminal for each of the groups, a step of sharing a drive circuit for driving the thermal heads among the groups, and a step of applying an operating voltage to the common potential terminal of the group to be driven by the drive circuit, the thermal head driving method can be simplified. Moreover, in an embodiment, the thermal heads in the group not being driven can be preheated by application of a small current, thereby allowing high speed printing.

According to an aspect of the present invention, since a failure can be detected by detecting a current to be supplied to a power supply terminal while driving the thermal heads based on evaluation data, the failure can be detected.

DETAILED DESCRIPTION OF THE PREFERRED EMBODIMENT

First Embodiment

Figure 1:
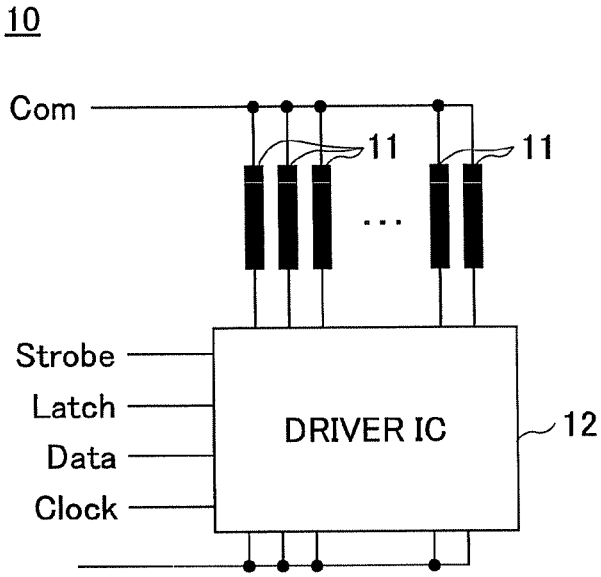
FIG. 1 is a block diagram showing a configuration of an IC-mounted drive circuit.
Figure 2:
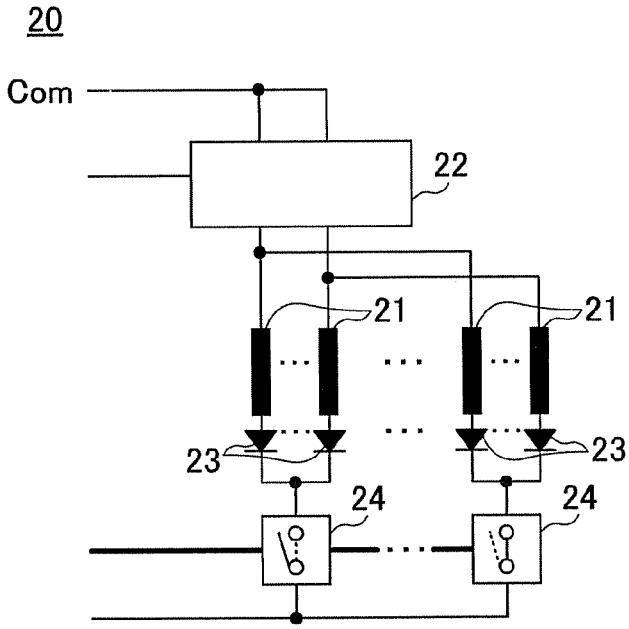
FIG. 2 is a block diagram showing a configuration of a diode matrix type drive circuit.
Figure 3:
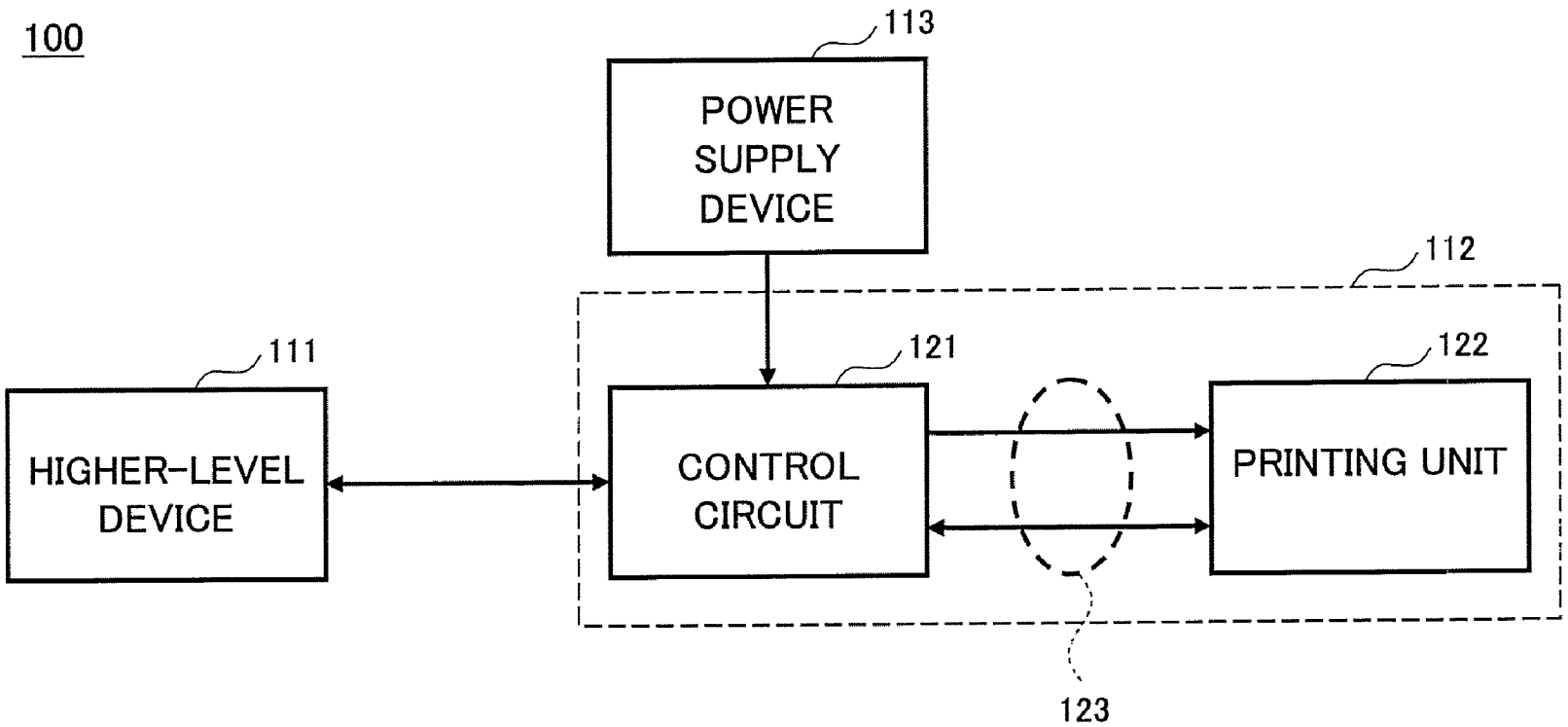
FIG. 3 is a block diagram showing a system configuration according to a first embodiment of the present invention.

FIG. 3 is a block diagram showing a configuration of a printing system 100 according to a first embodiment of the present invention.

The printing system 100 of this embodiment comprises a higher-level device 111, a printer 112, and a power supply device 113.

The higher-level device 111 comprises a computer system, and is adapted to provide print data to the printer 112. The printer 112 comprises a control circuit 121, a printing unit 122, and a connection cable 123. The control circuit 121 sends power, data, control signals, etc., to the printing unit 122 via the connection cable 123. The connection cable 123 comprises a bundle of plural thin connection lines so as to send drive power split into the thin connection lines. The connection cable 123 having this configuration can be easily flexed, and can therefore be easily handled.

The control circuit 121 controls the printing unit 122 based on the print data provided from the higher-level device 111. The printing unit 122 is controlled by the control circuit 121 to perform printing based on the print data.

The power supply device 113 supplies drive power to the printer 112. The printer 112 is driven by the power supplied from the power supply device 113 to perform printing.

Figure 4:
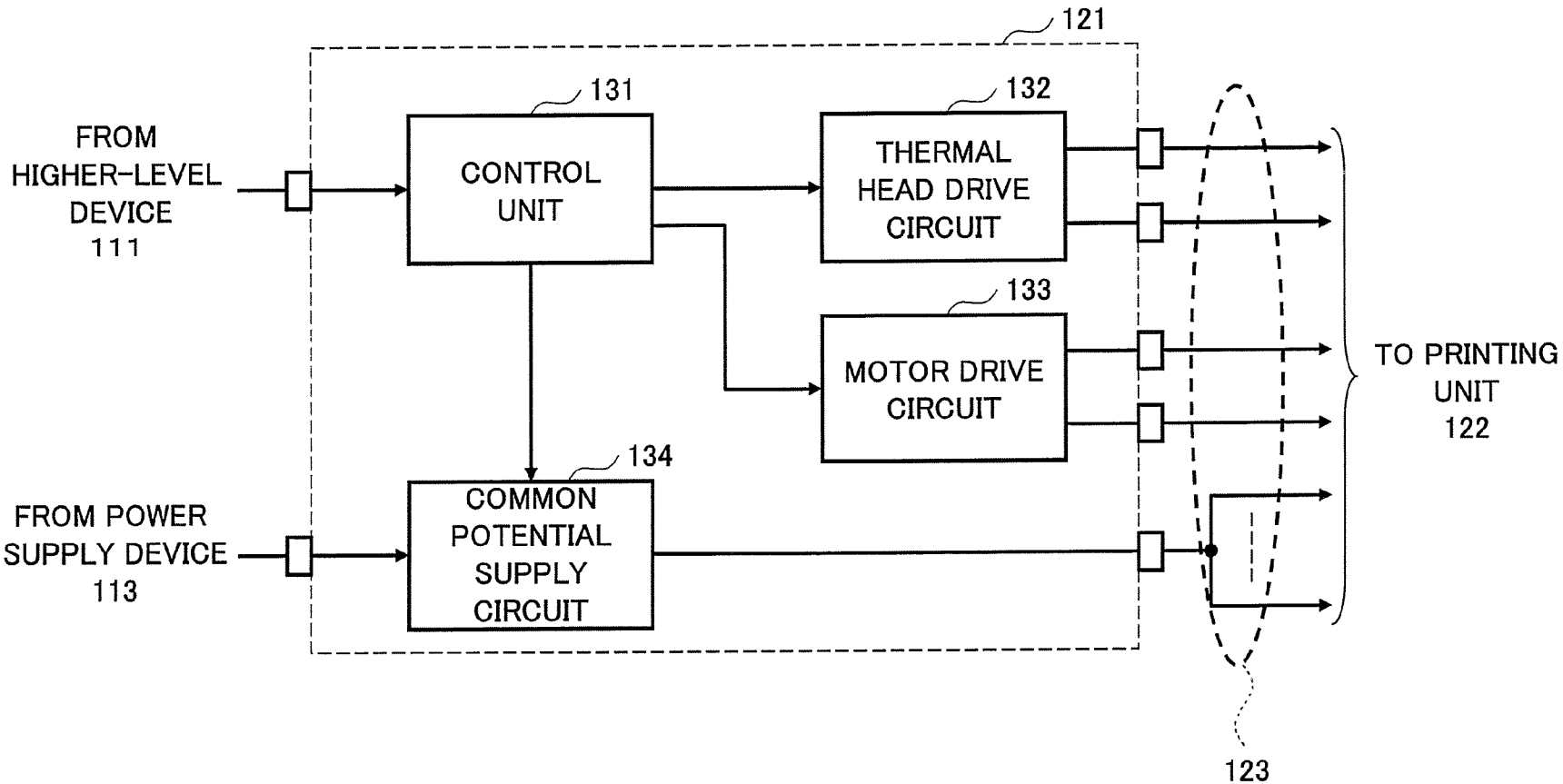
FIG. 4 is a block diagram showing a configuration of a control circuit.

FIG. 4 is a block diagram showing a configuration of the control circuit 121.

The control circuit 121 comprises a control unit 131, a thermal head drive circuit 132, a motor drive circuit 133, and a common potential supply circuit 134.

The control unit 131 receives commands and print data from the higher-level device 111 and performs various control operations for printing.

The thermal head drive circuit 132 is controlled by the control unit 131 to generate drive data for driving the printing unit 122 and provide the generated drive data to the printing unit 122.

The motor drive circuit 133 is controlled by the control unit 131 to generate drive signals for driving a paper feeder motor, for example, of the printing unit 122 and provide the generated drive signals to the printing unit 122.

The common potential supply circuit 134, which receives power supply voltage from the power supply device 113, is controlled by the control unit 131 to generate common potential as drive power and supply the generated common potential to the printing unit 122 via the connection cable 123. The common potential supply circuit 134 cooperates with the control unit 131 to detect a short circuit in the connection cable 123 and perform a safety operation of stopping power supply to the connection cable 123 upon detection of failure.

Figure 5:
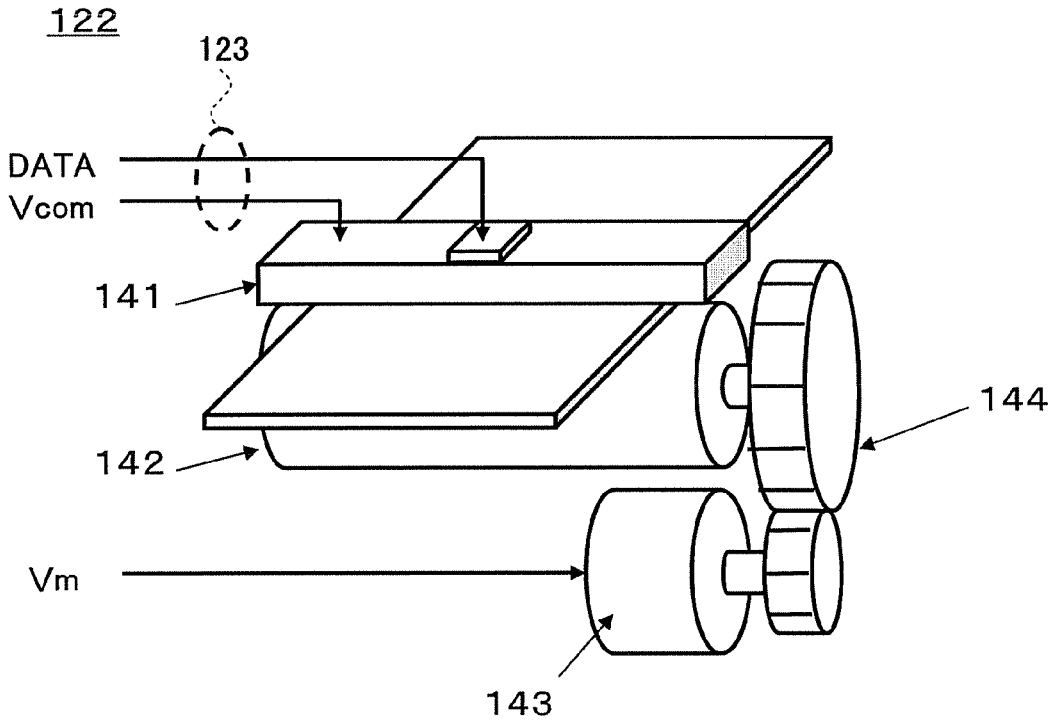
FIG. 5 is a schematic diagram showing a printing unit.
Figure 6:
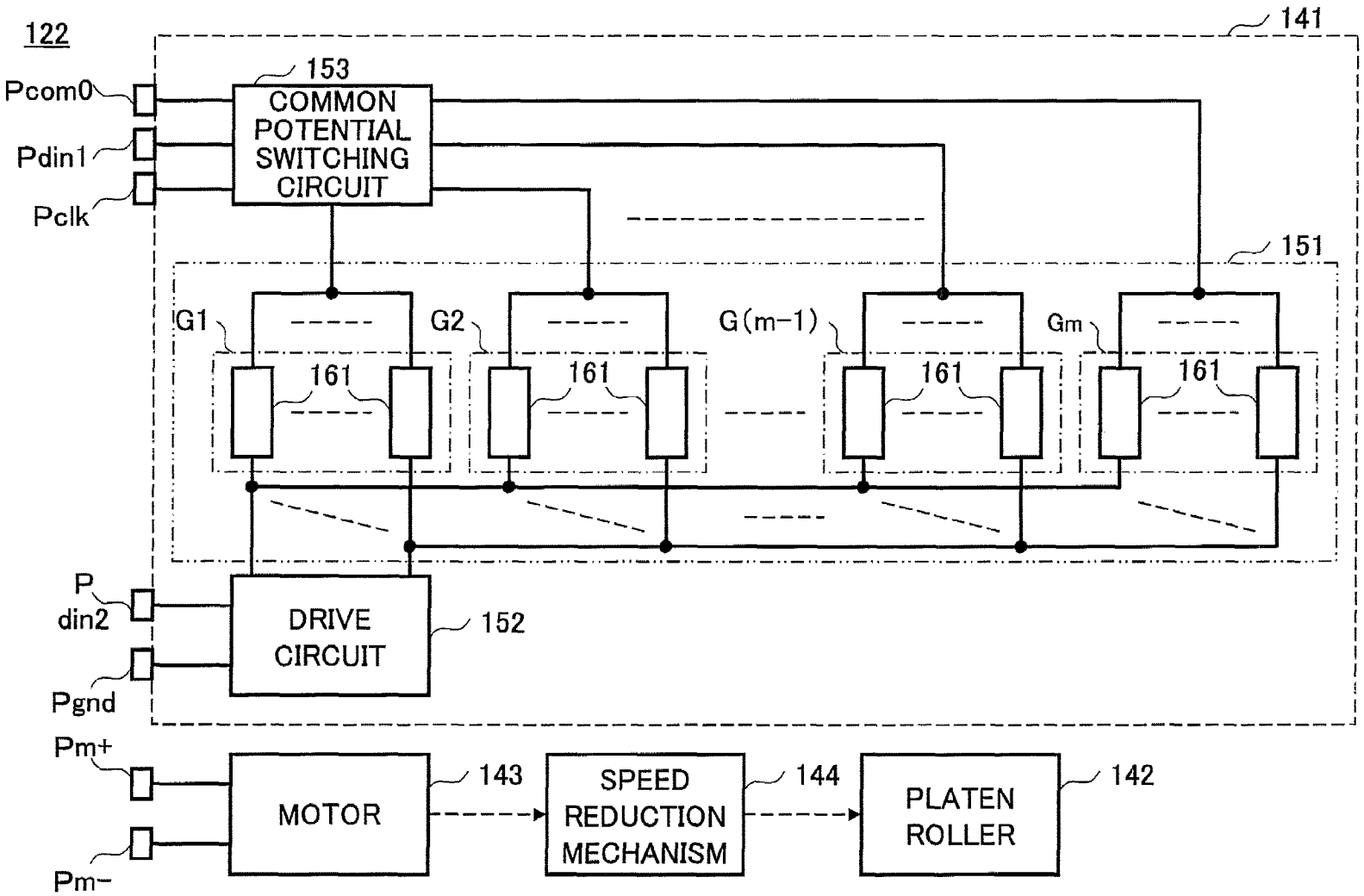
FIG. 6 is a block diagram showing a configuration of a printing unit.

FIG. 5 is a schematic diagram showing the printing unit 122, and FIG. 6 is a block diagram showing a configuration of the printing unit 122.

Referring to FIG. 6, the printing unit 122 comprises a thermal head unit 141, a platen roller 142, a motor 143, and a speed reduction mechanism 144.

The thermal head unit 141 comprises a thermal head part 151, a drive circuit 152, and a common potential switching circuit 153, which are mounted on a ceramic substrate. The thermal head part 151 comprises n×m heater elements 161 divided into m groups G1-Gm. In other words, each of the groups G1-Gm comprises n heater elements 161.

The heater elements 161 comprise, for example, resistive elements, and are configured to generate heat when current is applied. First ends of the heater elements 161 in the same group are connected to each other, and the connection point is connected to the common potential switching circuit 153. The common potential switching circuit 153 applies a common potential to the connection point of the first ends of the heater elements 161 in each group. Second ends of the heater elements 161 are connected to the drive circuit 152.

The exemplary drive circuit 152 is connected to the n heater elements 161 as illustrated, and drives the n heater elements 161 independently based on the print data provided from the control circuit 121. The common potential switching circuit 153 applies a common potential to the connection point of the first ends of the heater elements 161 in one or more groups of heater elements 161 to be driven, while open-circuiting or applying a predetermined potential to the connection point of the first ends of the heater elements 161 in the other groups.

<Operations>

Figure 7:
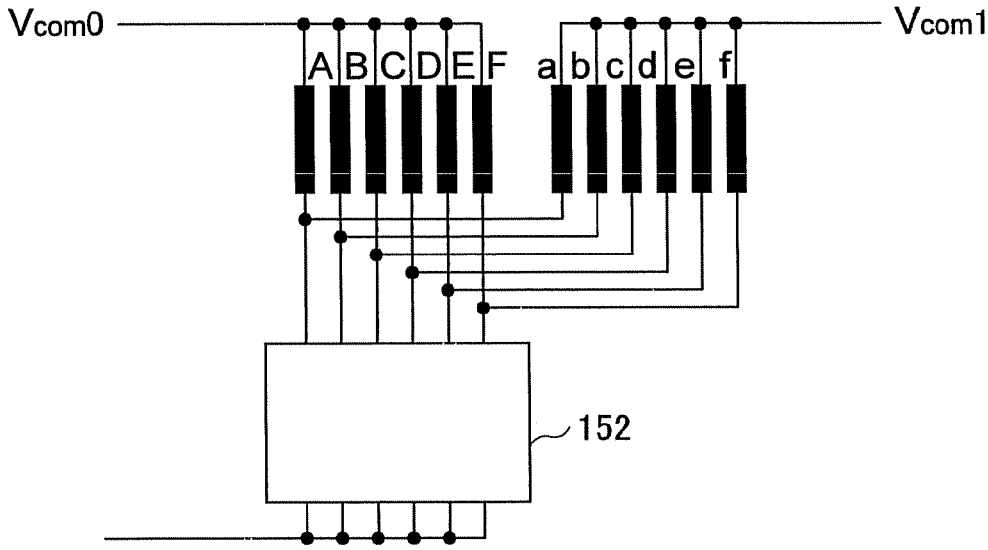
FIGS. 7-9 are diagrams for explaining operations according to the first embodiment of the present invention.
Figure 8:
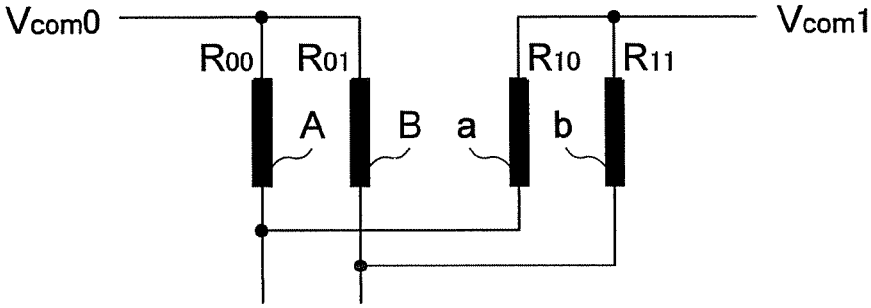
Figure 9:
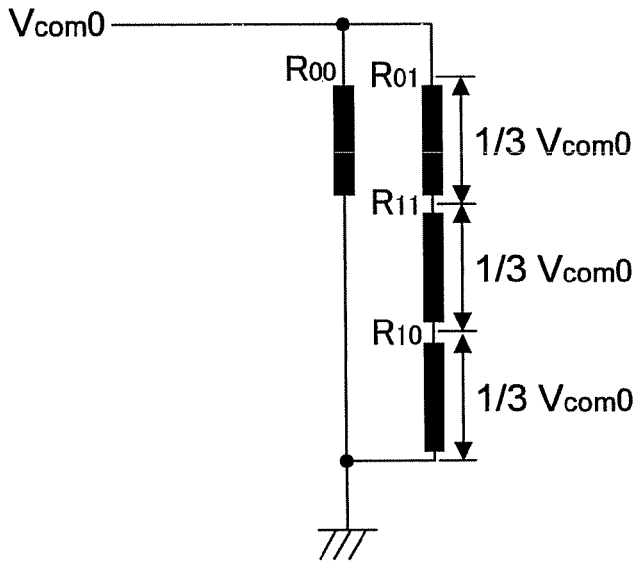

FIGS. 7-9 are diagrams for explaining operations according to a first embodiment of the present invention.

For ease of explanation, an example is given below in which a group comprising six heater elements A-F and another group comprising six heater elements a-f are provided.

In a condition where the heater elements A-F are driven and the heater elements a-f are not driven, the heater elements A, B, a, and b operate as described below. With reference to FIG. 8, R00, R0, R10, and R11 indicate the resistances of the heater elements A, B, a, and b, respectively.

When the heater element A is on and the heater element B is off, an equivalent circuit shown in FIG. 9 is formed when Vcom1 is open. The power consumed by each of the heater elements B, a, and b is expressed by the following equation:

$$\{Vcom0/3r\}^2 \times r = (1/9) \times \{Vcom0^2/r\},$$

wherein the resistances R00, R0, R10, and R11 of the heater elements A, B, a, and b are R00=R01=R10=R11=r and Vcom0 represents a common potential.

That is, the power consumed by each of the heater elements B, a, and b corresponds to 1/9 of the power consumed by the heater elements A. Accordingly, the coloring energy of each of the heater elements B, a, and b is 1/9 of the standard coloring energy. Therefore, colors are not developed by the heater elements B, a, and b. Each of the heater elements B, a, and b generates heat with the energy corresponding to 1/9 of the standard coloring energy, so that the heater elements B, a, and b are preheated.

Figure 10:
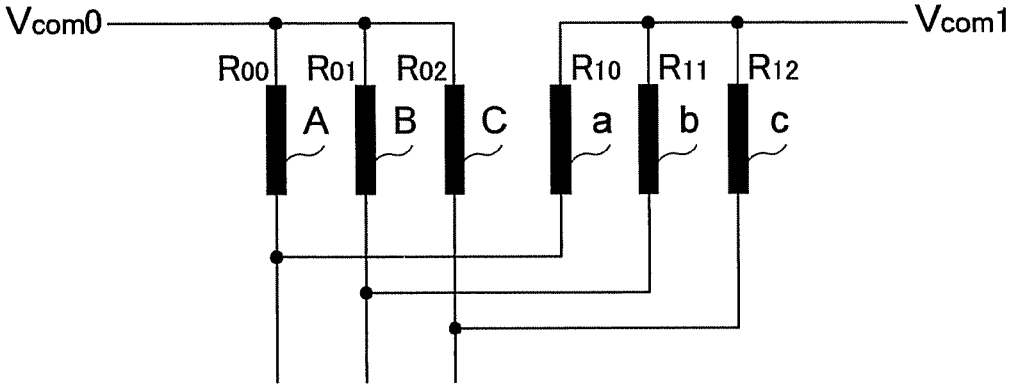
FIGS. 10-12 are diagrams for explaining operations in another condition according to the first embodiment of the present invention.
Figure 11:
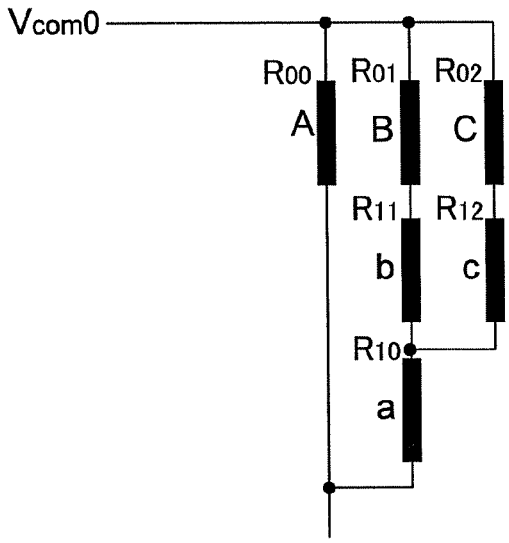
Figure 12:
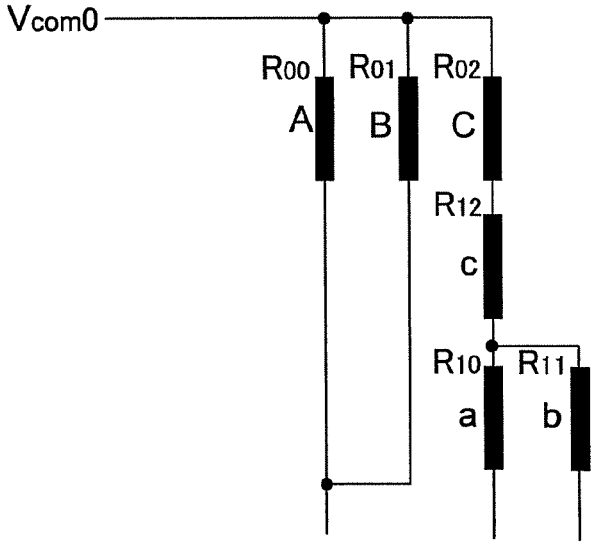

FIGS. 10-12 are diagrams for explaining operations according to the first embodiment of the present invention in another condition.

The heater elements A, B, C, a, b, and c operate as described below. With reference to FIG. 10, R00, R01, R02, R10, R11, and R12 indicate the resistances of the heater elements A, B, C, a, b, and c, respectively.

When the heater element A is on and the heater elements B and C are off, an equivalent circuit shown in FIG. 11 is formed. The combined resistance of the heater elements B, C, a, b, and c is 2r, wherein the resistances R00, R01, R10, and R11 of the heater elements A, B, C, a, b, and c are R00=R01=R02=R10=R11=R12=r and Vcom0 represents a common potential. The power consumed by each of the heater elements B, C, b, and c is 1/16 of the power consumed by the heater element A. The power consumed by the heater element a is 1/4 of the power consumed by the heater element A.

When the heater elements A and B are on and the heater element C is off, an equivalent circuit shown in FIG. 12 is formed. The power consumed by each of the heater elements C and c is expressed by the following equation:

$$\{Vcom0/(5r/2)\}^2 \times r = (4/25) \times \{Vcom0^2/r\}$$

That is, the power consumed by each of the heater elements C and c corresponds to 4/25 of the power consumed by each of the heater elements A and B. The power consumed by each of the heater elements a and b is 1/25 of the power consumed by each of the heater elements A and B. For this reason, the heater elements C, a, b, and c are not heated enough to develop colors, but are preheated.

In this embodiment, as described above, the drive circuit of the heater elements is simplified. Moreover, since the heater elements can be preheated while being off, they can be turned on by application of reduced energy. This enables increasing the printing speed.

In this embodiment, a common potential Vcom1 is not applied. However, the common potential Vcom1 corresponding to (⅓) Vcom0 may be applied so that ⅙ of the energy applied to the heater elements being on is applied to each of the heater elements being off.

<Protection Operations>

The following describes protection operations performed by the control unit 131 and the common potential supply circuit 134.

Figure 13:
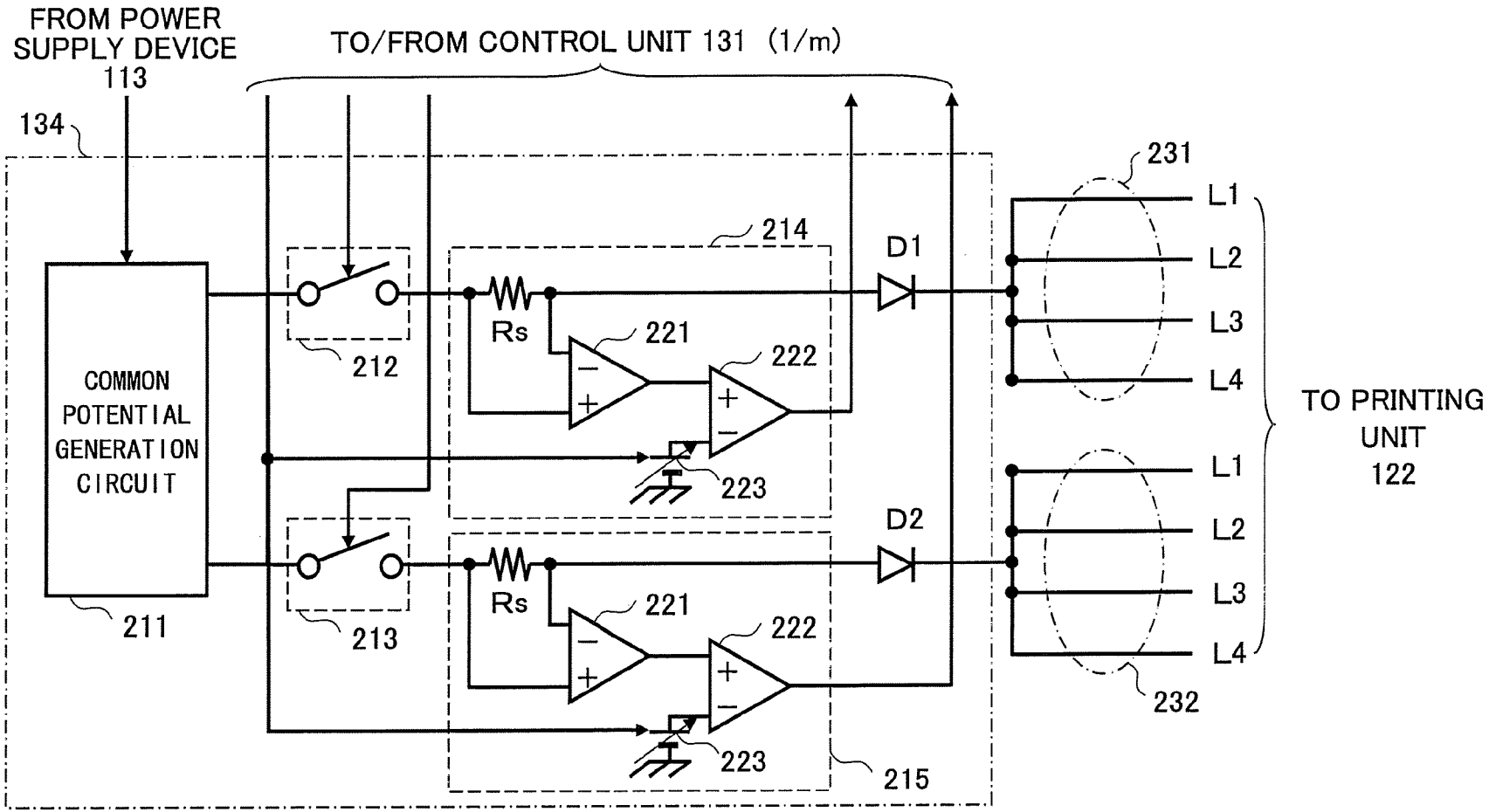
FIG. 13 is a circuit diagram showing a common potential supply circuit.

FIG. 13 is a circuit diagram showing the common potential supply circuit 134.

The common potential supply circuit 134 comprises a common potential generation circuit 211, a first switching circuit 212, a second switching circuit 213, a first current detection circuit 214, a second current detection circuit 215, and rectifier diodes D1 and D2.

The common potential generation circuit 211 receives a power supply voltage from the power supply device 113, and generates, for example, two different levels of common potentials based on the power supply voltage received from the power supply device 113. The common potential generated by the common potential generation circuit 211 is sent to a first power supply line 231, which is a part of the connection cable 123, via the first switching circuit 212, the first current detection circuit 214, and the rectifier diode D1, and sent to a second power supply line 232, which is a part of the connection cable 123, via the second switching circuit 213, the second current detection circuit 215, and the rectifier diode D2.

In the illustrated exemplary embodiment, each of the first power supply line 231 and the second power supply line 232 comprises, for example, four leads L1-L4. With this configuration, since the power is supplied through the plural leads, thinner leads can be used compared to the case where the power is supplied through one lead. As mentioned above, the connection cable 123 with thinner leads can be handled more easily.

The first switching circuit 212 and the second switching circuit 213 are turned on or off in response to a switching signal from the control unit 131.

The first current detection circuit 214 comprises a detection resistor Rs, an error amplifier 221, a comparator 222, and a reference supply 223.

The detection resistor Rs is connected serially between the first switching circuit 212 and the first power supply line 231, and configured to generate at both ends thereof a voltage corresponding to a current sent to the first power supply line 231. The error amplifier 221 is connected at its non-inverting terminal to a connection point between the detection resistor Rs and the first switching circuit 212, and is connected at its inverting terminal to a connection point between the detection resistor Rs and the first power supply line 231. The error amplifier 221 outputs a detection signal corresponding to the voltage generated by the detection resistor Rs. The detection signal output from the error amplifier 221 is provided to a non-inverting terminal of the comparator 222. The reference supply 223 applies a reference voltage to an inverting input terminal of the comparator 222. The reference supply 223 can be controlled by the control unit 131.

The comparator 222 switches its output to high if the detection signal output from the error amplifier 221 is greater than the reference voltage, and switches its output to low if the detection signal output from the error amplifier 221 is smaller than the reference voltage. The output of the comparator 222 is provided to the control unit 131.

The second current detection circuit 215 is connected between the second switching circuit 213 and the second power supply line 232, and has the same configuration as the first current detection circuit 214.

The control unit 131 detects the output of the comparators 222 while the printing unit 122 is driven based on evaluation data provided from the control unit 131, and thus detects a leak current from the first power supply line 231 and the second power supply line 232, and controls the first switching circuit 212 and the second switching circuit 213.

Figure 14:
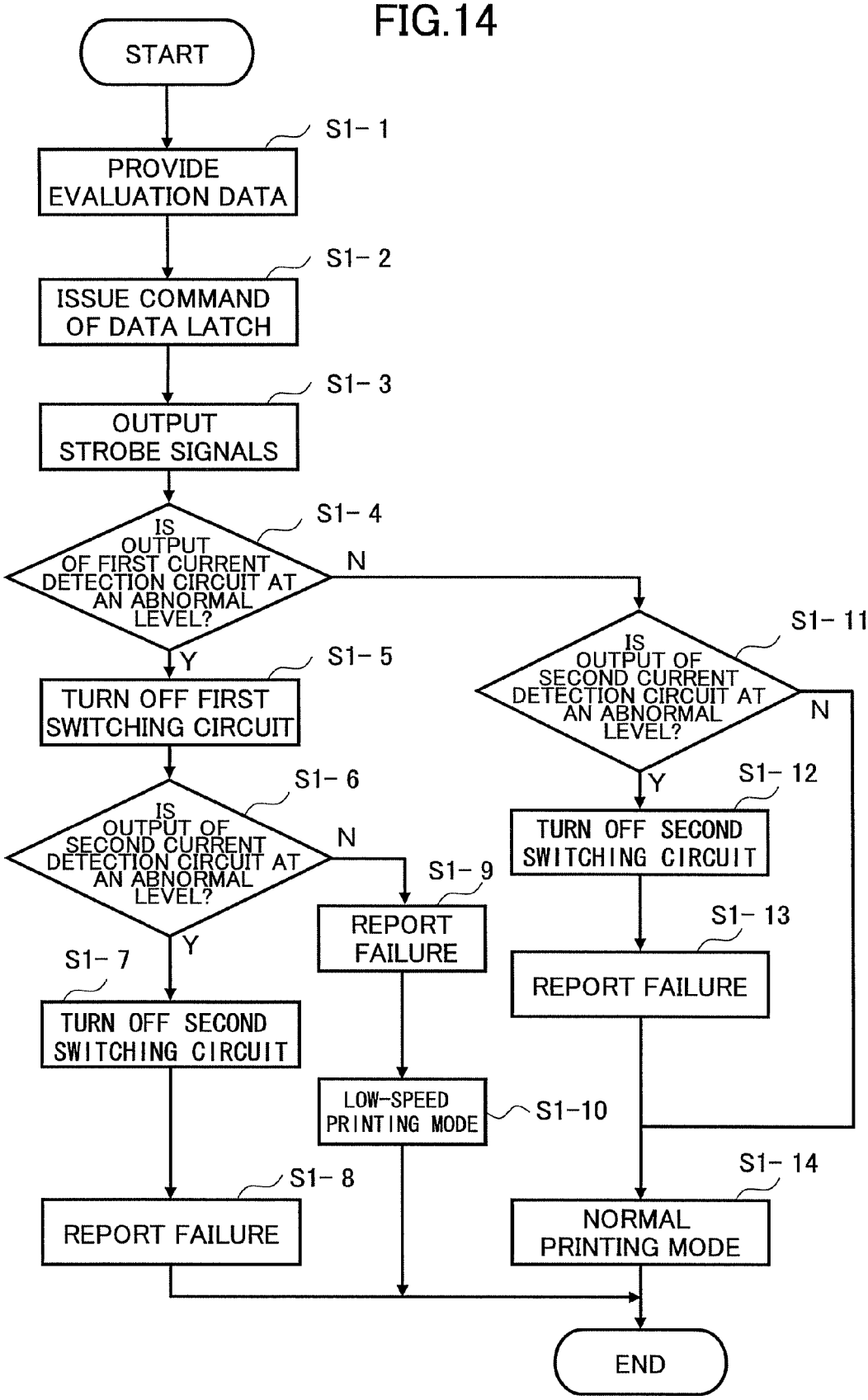
FIG. 14 is a flowchart showing operations performed by a control unit.

FIG. 14 is a flowchart showing an exemplary embodiment of operations performed by the control unit 131.

The control unit 131 provides the evaluation data to the printing unit 122 in Step S1-1, and issues a command of data latch in Step S1-2. In Step S1-3, the control unit 131 outputs strobe signals so as to drive the printing unit 122 based on the evaluation data. As the evaluation data used herein do not require printing or coloring, current is applied to heater elements 161 for a short period of time.

In Step S1-4, the control unit 131 determines whether the output of the first current detection circuit 214 is at an abnormal level. If, in Step S1-4, the output of the first current detection circuit 214 is determined to be at an abnormal level, there might be a failure such as a short circuit in the first power supply line 231. The control unit 131 therefore turns off the first switching circuit 212 in Step S1-5.

Then, in Step S1-6, the control unit 131 determines whether the output of the second current detection circuit 215 is at an abnormal level. If, in Step S1-6, the output of the second current detection circuit 215 is determined to be at an abnormal level, there might be a failure in the second power supply line 232. The control unit 131 therefore turns off the second switching circuit 213 to stop sending a current to the second power supply line 232 in Step S1-7, and reports a failure in the connection cable 123 to the higher-level device 111 in Step S1-8. In this case, as there might be failures in the first power supply line 231 and the second power supply line 232, printing is not performed.

If, in Step S1-6, the output of the second current detection circuit 215 is not determined to be at an abnormal level, the control unit 131 reports to the higher-level device 111 that there is a failure in the first power supply line 231. In this case, since a small drive current can be sent via the second power supply line 232, the control unit 131 reports the failure to the higher-level device 111 in Step S1-9 and performs printing in a low-speed printing mode in Step S1-10. In the low-speed printing mode, printing is performed at lower speed and with smaller drive current than usual. Accordingly, printing can be performed with the small current sent via the second power supply line 232.

If, in Step S1-4, the output of the first current detection circuit 214 is not determined to be at an abnormal level, then in Step S1-11 the control unit 131 determines whether the output of the second current detection circuit 215 is at an abnormal level. If, in Step S1-11, the output of the second current detection circuit 215 is determined to be at an abnormal level, there might be a failure in the second power supply line 232. The control unit 131 therefore turns off the second switching circuit 213 to stop sending a current to the second power supply line 232 in Step S1-12, and reports the failure in the second power supply line 232 to the higher-level device 111 in Step S1-13.

In this case, a small drive current can be sent via the first power supply line 231 to the printing unit 122. Accordingly, in this embodiment, in Step S1-14, the control unit 131 performs printing in the normal-speed printing mode.

If, in Step S1-11, the output of the second current detection circuit 215 is determined not to be at an abnormal level, the control unit 131 performs printing in a normal printing mode in Step S1-14.

In this embodiment, the control unit 131 detects a current flowing in each of the first power supply line 231 and the second power supply line 232 for supplying a common potential to the printing unit 122 while the printing unit 122 is driven based on the evaluation data provided from the control unit 131, and thus can detect a failure such as a short circuit in each of the first power supply line 231 and the second power supply line 232. Accordingly, failures such as short circuits in the first and second power supply lines 231 and 232 can be detected.

As described above, the first power supply line 231 and the second power supply line 232 for supplying a common potential to the printing unit 122 are provided. This configuration allows supplying power from the second power supply line 232 to the printing unit 122 if there is a failure in the first power supply line 231, and supplying power from the first power supply line 231 to the printing unit 122 if there is a failure in the second power supply line 232. Moreover, by switching the printing mode to the low-speed printing mode, printing can be performed without imposing a large workload on the first or second power supply line 231 or 232.

The first and second power supply lines 231 and 232 may be provided for each block so as to detect failure in each of the first power supply line 231 and the second power supply line 232. With this configuration, more detailed control can be implemented. For example, a driver element not being driven can be driven at ⅓ potential or can be off depending on the conditions of the first power supply line 231 and the second power supply line 232.

The present application is based on Japanese Priority Application No. 2005-253863 filed on Sept. 1, 2005, with the Japanese Patent Office, the entire contents of which are hereby incorporated by reference.

What is claimed is:

1. A control circuit that drives a thermal head with a common potential supplied via a power supply terminal, comprising:

first and second current detection circuits that detect respective first and second currents supplied in respective first and second power supply lines to the power supply terminal;

a control unit that detects a failure in the first and second power supply lines by detecting the current to be supplied to the power supply terminal while the thermal head is driven based on evaluation data; and first and second switching circuits that switch supply and suspension of supply of power to the respective first and second power supply lines, wherein:

when a failure is detected in the first power supply line and not the second power supply line, the control unit controls the first switching circuit to suspend supply of power to the first power supply line and performs printing in a low-speed printing mode using a low-speed printing mode drive current supplied via the second power supply line to the power supply terminal.

2. The control circuit as claimed in claim 1, further comprising:

when a failure is detected in either the first and second power supply lines, the control unit performs printing in a normal printing mode.

3. The control circuit as claimed in claim 1, further comprising:

when a failure is detected in both the first and second power supply lines, the control unit controls the first and second switching circuits to suspend supply of power to the respective first and second power supply lines.

* * * * *